US005682964A

United States Patent [19]

Murphy

[11] Patent Number: 5,682,964

[45] Date of Patent: Nov. 4, 1997

[54] BRAKE BEAM WEAR PLATE

[75] Inventor: Richard F. Murphy, Batavia, Ill.

[73] Assignee: Zeftek, Inc., Montgomery, Ill.

[21] Appl. No.: 720,247

[22] Filed: Sep. 26, 1996

[51] Int. Cl.[6] ..... B61H 13/26; B61H 13/24

[52] U.S. Cl. ..... 188/52; 188/233.3

[58] Field of Search ..... 188/52, 197, 207, 188/212, 214, 219.1, 233.3; 384/908, 909, 911; 403/13, 14

[56] References Cited

U.S. PATENT DOCUMENTS

| | | | |
|---|---|---|---|
| 2,553,345 | 5/1951 | Willis | 188/212 |
| 2,808,906 | 10/1957 | Busch | 188/233.33 |
| 3,020,984 | 2/1962 | LeBeau | 188/212 |
| 4,133,434 | 1/1979 | Chierici | 213/61 |
| 4,471,857 | 9/1984 | Murphy | 188/52 |
| 5,421,437 | 6/1995 | Malaehowski | 188/52 |

*Primary Examiner*—Matthew C. Graham
*Assistant Examiner*—Chris Schwartz
*Attorney, Agent, or Firm*—Lloyd L. Zickert; Adam H. Masia

[57] ABSTRACT

A brake beam wear plate for mounting in brake beam guide brackets of railroad car truck side frames having side walls of varying thicknesses to define a slideway for the brake beam lugs providing a sloppy fit and a path of movement to obtain the ideal clasping angle and alignment for the brake shoes with the wheels, and thereby produce better train handling during braking, and uniform wearing of the shoes to enhance shoe life and reduce maintenance.

16 Claims, 3 Drawing Sheets

BRAKE BEAM WEAR PLATE

DESCRIPTION

This invention relates in general to a wear plate for guiding brake beam lugs in a braking system on a railroad car to improve train handling and increase the life of brake shoes and brake beam lugs, and more particularly to a wear plate of polymer material having means to cause the brake shoes to engage the wheels more squarely for better train handling during braking while enhancing brake shoe life and reducing maintenance costs.

BACKGROUND OF THE INVENTION

Braking systems on railroad car trucks include brake beams having brake shoes for engaging the wheels to apply braking forces. The brake beams include extensions, paddles or lugs at opposite ends which are guidingly received in the slideways of wear plates received by the guide brackets or pockets formed on the side frames of the truck. Under the standards of the American Association of Railroads (AAR), the brackets for 40, 50, 70 and 90–100 ton cars are inclined to the horizontal 14 degrees to carry the wear plates that define slideways for brake beam lugs or paddles to loosely fit in the wear plates and theoretically allow droop for obtaining an ideal 13-degree brake shoe clasping angle. In larger cars the brackets are cast at 16 degrees, and the ideal clasping angle of the brake shoes is 15 degrees. The wear plate slideways define the path of movement of the lugs and the brake beams and must provide such a loose or sloppy fit to avoid binding between the lugs and slideways, as where binding may occur brake malfunction is encountered that adversely affects train handling.

The wear plate standard adopted by the Association of American Railroads in the early 1960's (S-367-78) defined the wear plate to be made of spring steel. This wear plate is U-shaped in cross section and formed to have wall thicknesses such as to eliminate binding with the brake beam extensions so that the brake beams would not hang up in braking position, as the release of brakes relies on gravitational forces to back the shoes away from the wheels. Even when the steel wear plates are new, a droop of the brake beam may be encountered that can cause uneven brake shoe wear. Since the brake beam extensions are made of metal, the metal-to-metal contact quickly causes wear that accentuates drooping of the brake beams and uneven brake shoe wear as well as the need for brake shoe replacement. Standard maintenance specifications mandate replacement when one end of the shoe is worn excessively. Further, brake beam droop is caused by wearing of the brake beam lug at the corners which added to the uneven wearing of the shoes. Braking efficiency is reduced during such uneven wearing that adversely affects train handling.

In the early 1980's a plastic wear plate was developed which had self-lubricating characteristics and was intended to overcome the wearing problem on the brake beam lugs, as disclosed in U.S. Pat. No. 4,471,857, which also intended to provide a solution to the brake beam drooping problem that causes uneven brake shoe wear. However, this brake beam wear plate, as disclosed and claimed, was basically inoperative as it required walls of such thickness that the lug would be closely received to produce cock-free movement of the lugs. Inasmuch as a cock-free lug movement caused the lugs to maintain the same 14-degree inclination of the brackets, the ideal 13-degree clasping angle was not achieved, resulting in uneven brake shoe wear. Further, the tight fit would cause binding between the wear plate and the lug such as to maintain the brake shoe in braking position and cause undue wear. Thus, maintenance costs in the replacement of shoes having uneven or excessive wear were high.

Therefore, the brake beam droop problem causing uneven wear of brake shoes has not been solved by the plastic wear plate in the above mentioned patent. More significantly, the owner of the above patent found that making a plastic wear plate in accordance with the patent was not acceptable, and therefore designed the wear plate to provide a sufficient slop or tolerance between the plate and lugs to prevent binding. This design results in producing a 12-degree clasping angle between the brake shoe and the wheel that causes uneven wear of the brake shoe. Further, plastic brake beam wear plates previously available have been subject to cold flow that exacerbates the droop problem and uneven shoe wear.

SUMMARY OF THE INVENTION

The present invention is to a wear plate that overcomes the problems of the prior art by including means for obtaining substantially the ideal clasping angle between the brake shoes and the wheels as dictated by the guidance of the brake beams, while allowing sufficient slop or tolerance between the brake beam lugs and the wear plates to avoid binding and accommodate appropriate brake release. The wear plate of the invention is formed of a polymer material that is resistant to cold flow and includes means for driving the brake beams during the braking cycle along an incline upwardly from the axis of the brake beam guide bracket to cause the brake shoe to substantially squarely engage the wheels at the ideal clasping angle. This results in substantially extending the life of the brake shoes by obtaining uniform wear along the entire arc of the shoes and providing better braking and train handling. Accordingly, maintenance costs are substantially reduced as the need for brake shoe replacement and/or wear plate replacement are substantially decreased. Moreover, an improved polymer material is used for the wear plates of the present invention to enhance the life of the wear plates. It expected that the period between maintenance requirements may be nearly doubled with the present invention.

It is therefore an object of the present invention to provide a new and improved wear plate for brake beam guide brackets that enhances braking and train handling, as well as the life of the brake shoes, and thereby reduces overall maintenance costs, including parts and labor and improves train performance.

Another object of the present invention is in the provision of a new and improved wear plate for brake beam guide brackets that includes means in the slideway of the wear plate to cause the brake beam to drive the brake shoes against the wheels at the ideal clasping angle of 13 degrees, thereby resulting in improved braking and enhancing the life of the brake shoes.

A still further object of the present invention is in an improved wear plate for a brake beam guide bracket having unequal wall thicknesses to angularly direct the brake beam guide extensions so that the brake shoes engage the wheels at the ideal clasping angle.

Another object of the present invention resides in the provision of a wear plate for a brake beam guide bracket formed of a material that enhances the life of the wear plate and provides over its life a substantially consistent slideway path to cause the brake shoes to essentially have the perfect clasping angle with the wheels, thereby substantially enhancing brake shoe life and also providing better braking action.

Other objects, features and advantages of the invention will be apparent from the following detailed disclosure, taken in conjunction with the accompanying sheets of drawings, wherein like reference numerals refer to like parts.

DESCRIPTION OF THE INVENTION

Figure 1:
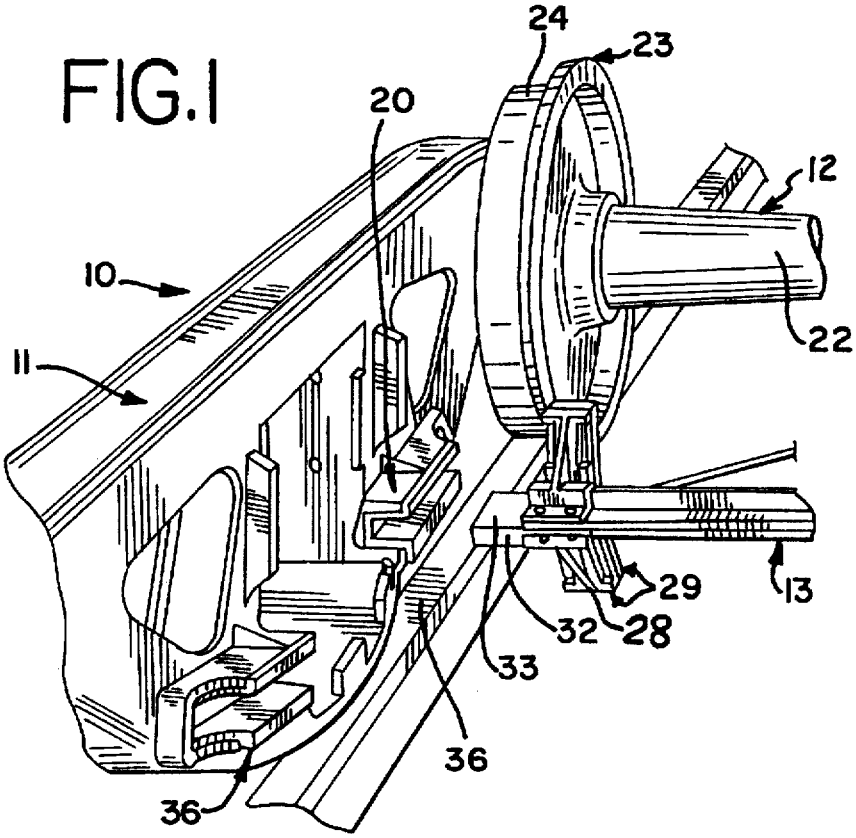
FIG. 1 is a fragmentary perspective view of a side frame of standard railroad car truck and braking elements with some parts omitted for purposes of clarity and other parts in exploded position.
Figure 2:
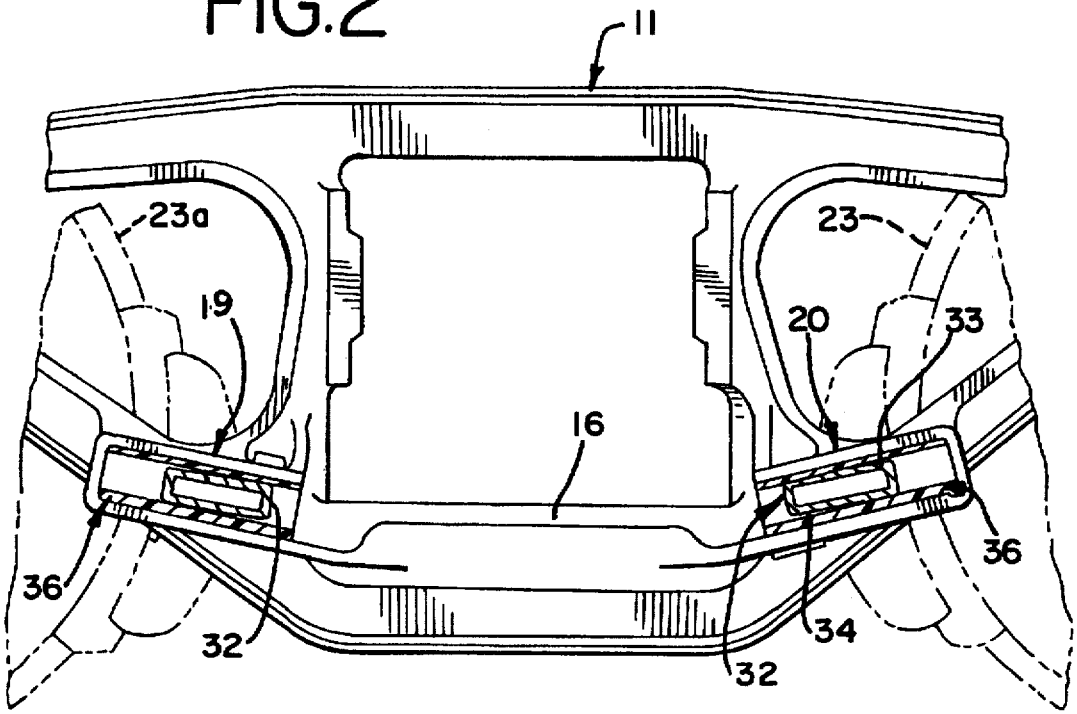
FIG. 2 is a fragmentary inside view of the side frame to show the relation between the brake beam guide lugs, the wear plate, and the brake beam guide bracket.

Referring now to FIGS. 1 and 2, it will be understood that for purposes of understanding the wear plate of the present invention, only a portion of a railroad car truck need be illustrated. Further, while car trucks may vary in structure, they all include opposed side frames resting on wheeled axles, a bolster for interconnection with the car, and braking equipment. Each truck would include a pair of axles, a brake beam with shoes for the wheels of each axle, and a common drive or actuating mechanism for causing the brake beams to move between braking and non-braking positions.

As seen in FIG. 1, a car truck 10 is shown which includes a side frame 11, a wheeled axle 12, and a brake beam 13. It will be understood that a pair of opposed and spaced apart side frames would be provided for the truck as well as a pair of wheeled axles on which the side frames would be supported. Further, it would be understood that a bolster would be arranged between the axles and the side frames and resiliently supported by spring groups on the side frames.

Figure 7:
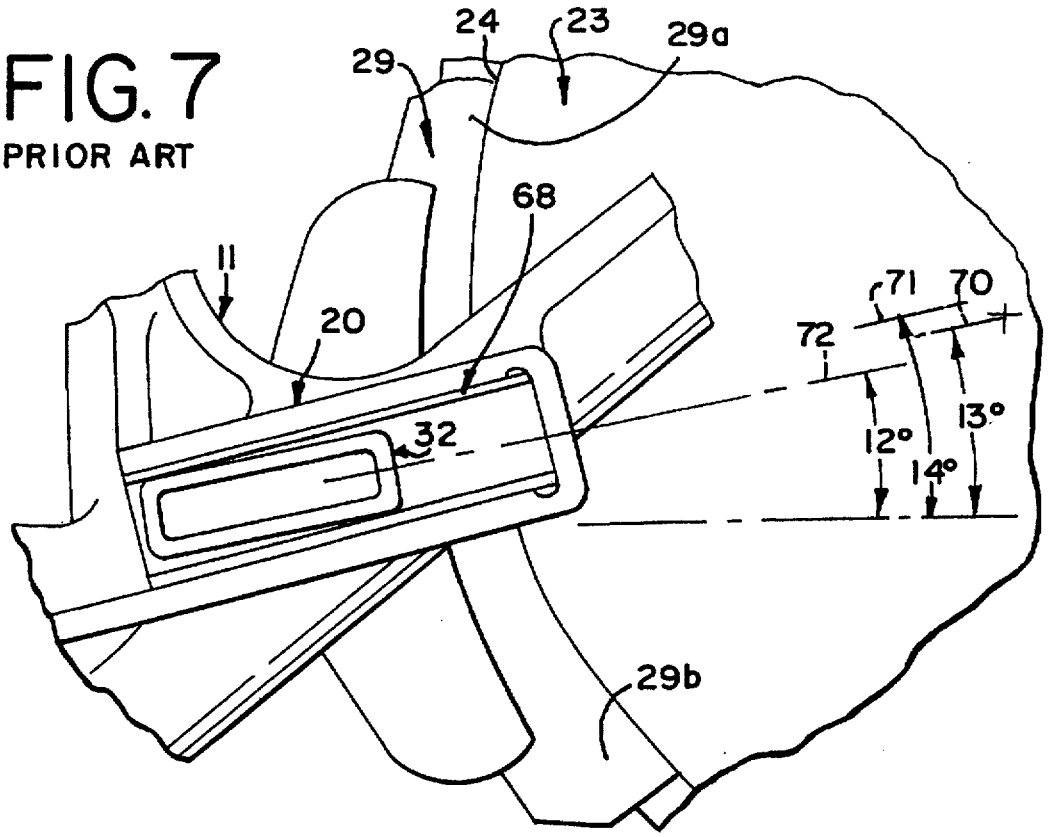
FIG. 7 PRIOR ART
FIG. 7 is a diagrammatic view of a prior art wear plate in a bracket, and a brake beam lug in the wear plate to illustrate the braking angle achieved.

More particularly, each side frame 11 includes a side frame spring seat 16 on which a spring group would rest by use of a suitable transom. Further, the side frame includes brake beam guide brackets or pockets 19 and 20 for receiving brake beams to act on the respectively adjacent wheels. The side frames are usually cast steel or iron and the brackets are cast into the side frames. The wheeled axle 12 includes an axle 22 and opposed wheels 23 having brake shoe engaging surfaces 24. As seen in FIG. 2, front and rear wheels 23 and **23*a* are shown in phantom adjacent brake beam guide brackets. As also noted in FIG. 2, guide brackets 19 and 20 include longitudinal axes that according to AAR standards are inclined from the horizontal at 14 degrees for 40, 50, 70 and 90–100 ton cars and at 16 degrees for 125 ton cars. For illustrating the present invention the guide brackets are at 14 degrees. Further, it should be understood that the ideal clasping angle of the brake shoes with the wheels is along a 13-degree path lying along a radius of the wheel for the 14-degree brackets, although the droop of the brake beams even with the wear plates presently marketed will produce a 12 degree clasping angle that results in uneven brake shoe wear, and particularly more wear at the upper ends of the shoes than at the lower ends, as seen in FIG. 7. Thus, the longitudinal axes of the brackets lie above a radius of the wheel. The guide brackets 19 and 20** are oppositely and upwardly inclined to guide the brake beams upwardly during a braking operation.

Each brake beam includes a brake shoe bracket 28 at each end and on which is mounted a brake shoe 29. The brake beam also includes at opposite ends brake beam extension lugs or paddles 32 that are adapted to be received by the wear plate of the guide bracket although shown in removed position in FIG. 1 and in installed positions in FIG. 2. This lug is made of steel and therefore would have steel-on-steel contact if the wear plate were also made of steel. Further, the lug is rectangular in cross section with top and bottom contact surfaces 33 and 34 that would be received by the wear plate.

The brake beam guide brackets define pockets having a longitudinal axis inclined at 14 degrees to the horizontal and which receive a wear plate. As seen in FIGS. 1 and 2, the pockets are U-shaped in cross section and receive a brake beam wear plate 36 of the invention.

Figure 3:
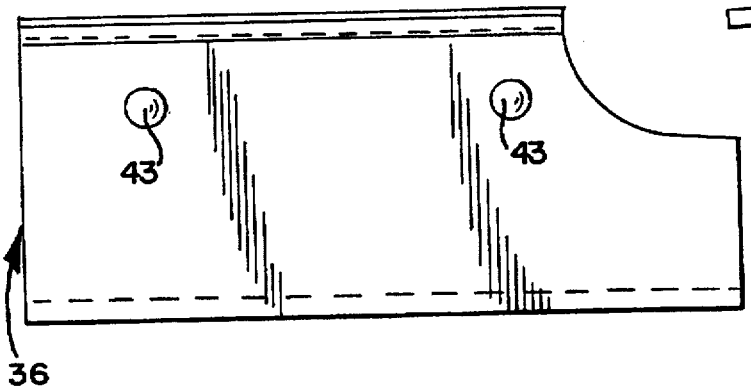
FIG. 3 is a side elevational view of the brake beam wear plate of the present invention.
Figure 4:
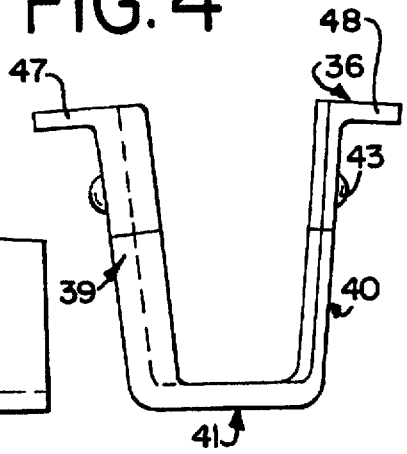
FIG. 4 is an end elevational view of the wear plate of FIG. 3 as it appears prior to mounting in a bracket and looking substantially along the arrows 4—4 of FIG. 3.

As seen in FIGS. 3 and 4, the brake beam wear plate 36 of the invention is illustrated prior to be mounted in the pocket of a brake beam guide bracket. The wear plate is U-shaped in cross section and includes generally opposed walls 39 and 40 and an interconnected end wall 41. Wall 39 is the lower wall and thicker than the upper wall 40. The body of the wear plate is molded from a suitable polymer and preferably from a suitable glass-filled black urethane. One satisfactory polymer is marketed by Union Carbide as 59300. Where lubrication is desired, the lubricating agent may be molybdenum disulphate, silicone, polytetrafluorethylene, or an equivalent and added to the urethane. Further, a super high-impact polypropylene, a filled nylon or a polycarbonate may be used. All of these polymers are resistant to cold flow. As shown in rest position in FIG. 4, the opposite side walls 39 and 40 are diverging and would be brought into substantial parallel relation when the wear plate is mounted in a brake beam guide bracket. Detents 43 are provided on the outer surfaces of the side walls for mating with indents formed in the pocket of a guide bracket and coact with the memory characteristics of the wear plate to retain the wear plate in position in the guide bracket pocket. The side walls will want to spring back to the position shown in FIG. 4 and in this respect then apply a retaining force to assist in holding the wear plates in position in a pocket. Otherwise, it will be appreciated that the exterior dimensions of the wear plate are such as to matingly conform to the pocket of the guide bracket. Further, lips 47 and 48 are provided at the free edges of the side walls to seat on the guide bracket as shown in FIG. 1 and properly position the wear plate in the guide bracket, as well as properly position the detents in the indents.

Figure 5:
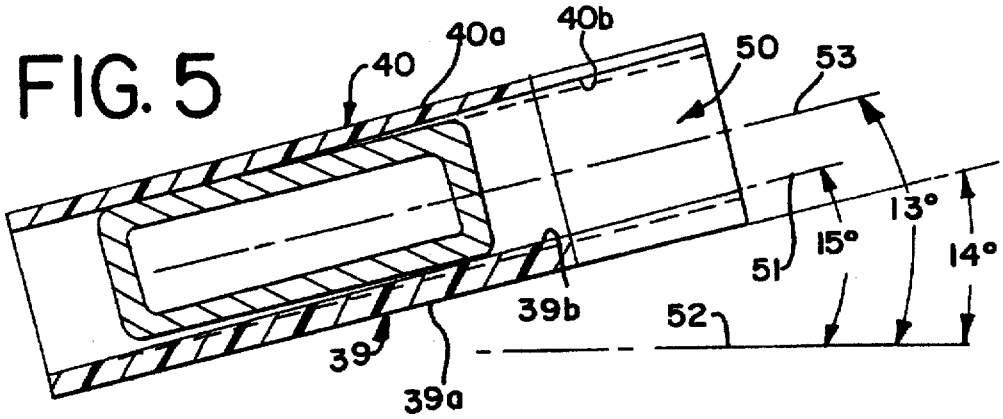
FIG. 5 is a somewhat diagrammatic longitudinal sectional view taken through the wear plate of the present invention and showing the operational relationship of a brake beam guide lug with the wear plate.

Referring now to FIG. 5, it can be seen that the side walls 39 and 40 of the wear plate 36 have unequal thicknesses throughout their length, thereby defining a slideway 50 having a longitudinal axis 51 that is inclined 15 degrees from the horizontal axis 52 causing the brake beam extension lug 32 to move from left to right at an upward incline 53 of 13 degrees because of the slop needed to properly allow release of the brakes and downward gravitational movement of the brake beam. The 13-degree path produces the ideal clasping relation between the shoes and wheels. It may be noted that the outer surfaces 39*a* and 40*a* are parallel to each other and would mate in the pocket of the guide bracket. Similarly, the inner surface of the walls as indicated by 39*b* and 40*b* are parallel to each other and to the longitudinal axis 51 of the slideway. The wall thicknesses are such that a slop fit is produced for the lug so that the lugs may easily slide in the wear plate when the brakes are released. The angle of the slideway compensates for the droop inherent in the fit of the lug and provides for the substantially perfect clasping of the brake shoe with the wheel, thereby resulting in uniform wear along the brake shoe to provide the most efficient braking and enhance brake shoe life.

As previously noted, the lower wall 39 is thicker than the upper wall 40 in order to provide the proper structural integrity to the wear plate as the lower wall will sustain greater forces than the upper wall due to gravity and the weight of the brake beam. This is also important in order to enhance the life of the wear plate. Thus, the wear plate 36 is formed to cause the brake beam guide to move along a path that will affect the nearly perfect clasping angle between the brake shoes and the wheels.

Figure 6:
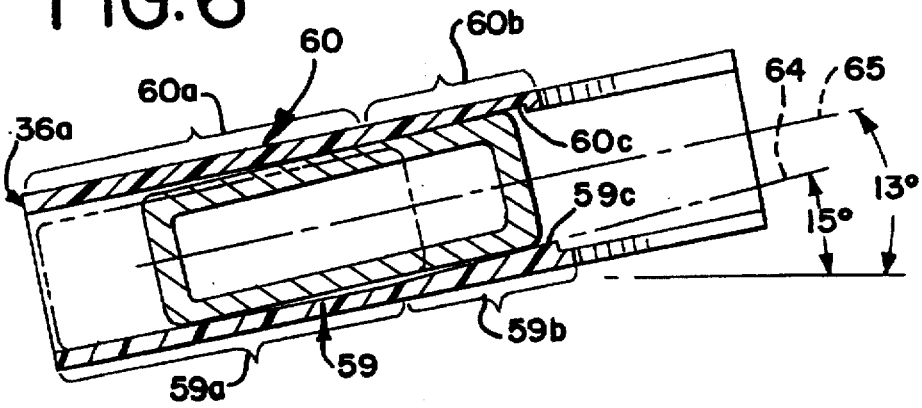
FIG. 6 is a view like FIG. 5 but showing a modification of the wear plate of the invention.

Another embodiment is shown in FIG. 6 and generally designated as 36A. This embodiment differs from the embodiment of FIGS. 1 to 5 in that the side walls are of the same thickness in the area where the brake beam extension lug 32 rests during the non-braking condition of the braking system, as shown in phantom. However, it should be appreciated the lower wall may be thicker than the upper wall, as in the earlier embodiment. This embodiment includes side walls 59 and 60 having a uniform thickness along the bracketed area 59*a* and 60*a*. In order to cause the extension lug to drive the brake shoes into the ideal clasping angle during braking operations, the side walls are provided with ramps 59*b* and 60*b* that will cause the extension lugs of the brake beam to tilt upwardly when driven into braking position and achieve the ideal clasping angle for the brake shoes. Preferably, the angle of the ramps is 15 degrees to horizontal as indicated at 64 where the opposed ramp faces 59*c* and 60*c* are parallel to cause the extension lugs to tilt the brake beam upwardly in the braking mode to the ideal clasping angle of 13 degrees, as seen at line 65.

Figure 8:
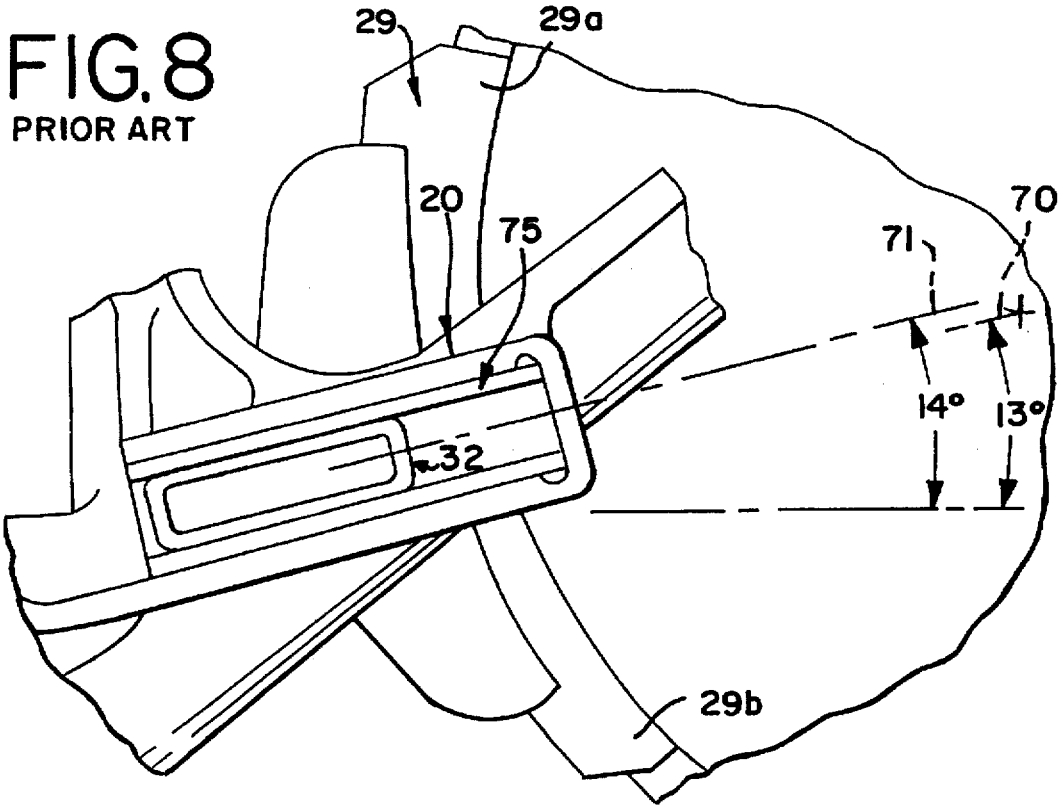
FIG. 8 PRIOR ART
FIG. 8 is a diagrammatic view of the prior art wear plate of the '857 patent in a bracket, and a brake beam lug in the wear plate to illustrate the braking angle achieved.

The problems of heretofore known wear plates are illustrated in FIGS. 7 and 8. In FIG. 7, a wear plate 68 is shown as received within the guide bracket 20. This wear plate, whether made of metal or plastic, is designed to allow sufficient slop or tolerance between the wear plate and the lug 32 so that during brake release the brake beam and brake shoes will back away from the wheel due to the gravitational forces that cause the lugs in the wear plates to slide down the incline of the wear plate slideway. In order to provide sufficient slop between the lugs and the wear plates, the resulting angle of the brake beam lugs, as well as the brake beam and the brake shoes, will be about 12 degrees from the horizontal and therefore about one degree off from the ideal clasping angle of 13 degrees. Successive braking operations thereafter cause the brake shoe to wear at the high side 29*a* at a greater rate than at the lower side 29*b*. This uneven wearing will cause faster depletion of the brake shoe and ultimately require replacement. Moreover, the 12-degree angle only prevails when the wear plate is new. As the wear plate wears, the angle decreases, thereby increasing the droop and the severity of shoe wear at 29*a*.

According to AAR standards, the brake shoes must be replaced when the thickness of the brake shoe at any place along the brake shoe reaches a predetermined thickness. Moreover, where uneven wear is encountered, braking efficiency is likewise reduced, which adversely affects train handling. The ideal clasping angle achievable by having the brake beam travel along a 13-degree path is indicated at 70, while a 14-degree inclination of the bracket is indicated at 71. The 12-degree path of wear plate 68 resulting in this prior art wear plate is indicated at 72, which would result in uneven wear.

In FIG. 8, a prior art wear plate 75 is shown in relation to the brake beam lug 32 and as being mounted in the bracket 20. This wear plate is like that disclosed and claimed in the '857 patent in that the thickness of the side walls of the wear plate is such that the brake beam lugs attain a cock-free sliding relation with the slideway of the wear plate. When such a cock-free sliding relation is attained, the lugs move along a 14-degree incline path, the same inclination as the bracket, as illustrated by the path 71, which is greater than the ideal clasping angle 70 of 13 degrees, thereby causing the lower end 29*b* of the brake shoe to wear faster than the upper end 29*a*. This results in uneven brake wear and requires premature replacement of the brake shoes. Moreover, the close fit between the brake beam lugs and the wear plates additionally causes binding that inhibits the brake shoe from moving away from the wheel and further causes undue wear on the brake shoe. Again, the uneven application of the brake shoe to the wheel adversely affects braking and train handling.

It can be appreciated in view of the foregoing that the present invention overcomes the problems of the prior art and provides a wear plate that will allow the brake beams to be driven during braking so that the brake shoes will achieve the ideal clasping angles with the wheels to provide more efficient braking and enhance brake shoe life.

It will be understood that modifications and variations may be effected without departing from the scope of the novel concepts of the present invention, but it is understood that this application is to be limited only by the scope of the appended claims.

The invention is hereby claimed as follows:

1. A brake beam wear plate for a brake beam guide bracket on a side frame of a railroad car truck including at least one axle carrying a pair of wheels, wherein the bracket includes an elongated pocket with a longitudinal axis extending about 14 degrees from the horizontal for supporting a brake beam of a brake system and said brake beam includes brake shoes mounted in alignment with the wheels, said wear plate comprising a U-shaped body of polymer material having spaced apart upper and lower side walls and an interconnecting wall said side walls and interconnecting wall adapted to fit in said bracket pocket and define a slideway for and end of the brake beam, said slideway having opposed surfaces, and means on said slideway causing said brake beam to tilt upwardly when the brake system is actuated while providing a sloppy fit and space between the brake beam ends and the slideway surfaces such that the path of movement of the brake beam will be about 13 degrees from the horizontal and the brake shoes will engage the wheels at a substantially ideal clasping angle, whereby uniform wear of the shoes will be achieved to enhance shoe life and to acquire more efficient braking.

2. The wear plate of claim 1, wherein said slideway surfaces are parallel and inclined upwardly from the longitudinal axis of the pocket.

3. The wear plate of claim 2, wherein the thickness of the side walls varies throughout their length.

4. The wear plate of claim 1, wherein the lower side wall is thicker than the upper side wall.

5. The wear plate of claim 1, wherein said slideway means includes ramp means for tilting the beam end upwardly when the brake system is actuated.

6. The wear plate of claim 1, wherein the polymer material is resistant to cold flow.

7. A brake beam wear plate for a brake beam guide bracket on a side frame of a railroad car truck including at least one axle carrying a pair of wheels, wherein said bracket includes an elongated pocket with a longitudinal axis lying above a radius of the wheel and supporting a brake beam of a brake system and said brake beam includes brake shoes mounted in alignment with the wheels, said wear plate comprising a U-shaped body of polymer material having spaced apart upper and lower side walls and an interconnecting wall, said side walls and interconnecting wall adapted to fit in said bracket pocket and define a slideway having a sloppy fit for an end of the brake beam, and said side walls being of varying wall thickness to dispose the slideway at an angle greater than the longitudinal axis of the bracket while providing a sloppy fit so that the brake beam will be disposed at an angle less than the longitudinal axis of the pocket and move along a path substantially coincident with the wheel radius such that the brake shoes will engage the wheels at substantially an ideal clasping angle, whereby uniform wear of the shoes will be achieved to enhance shoe life and more efficient braking will be achieved.

8. The wear plate of claim 7, wherein the lower wall is thicker than the upper wall.

9. In a railroad car truck including spaced side frames supported on a pair of axles, each of which has a pair of wheels, a bolster intermediate said axles and side frames resiliently carried by said side frames, first and second brake beams extending perpendicularly to said side frames and disposed at opposite sides of the bolster, said brake beams having metal brake lugs and brake shoes at opposite ends, the brake shoes aligning with the wheels for applying braking forces to the wheels, the brake lugs having opposed parallel slide surfaces, guide brackets on said side frames defining pockets with a longitudinal axis lying above the radius of a wheel, and a wear plate received by the pockets defining a slideway for receiving the brake beam lugs, the improvement in the wear plate for a pocket which comprises:

a U-shaped body of polymer material having spaced apart upper and lower walls and an interconnecting wall, said body being formed to fit in a bracket pocket and the side walls applying retention forces to the bracket, said side walls defining a slideway to receive a brake beam lug in a sloppy fit that allows free sliding movement of the lug in the slideway, said slideway having means causing the brake beam to tilt upwardly when the drive means actuates the beams to cause the brake shoes to engage the wheels at a substantially ideal clasping angle, whereby uniform wear of the shoes will be achieved to enhance shoe life and braking.

10. The wear plate of claim 9, wherein the side walls of the slideway are parallel where the brake lugs rest during non-braking, and ramp means are provided in the slideways in the area where the lugs move during shoe engagement to tilt the shoes upward and cause substantially ideal clasping of the shoes with the wheels, whereby uniform wear of the shoes will be achieved to enhance shoe life and braking.

11. The wear plate of claim 10, wherein the polymer material is resistant to cold flow.

12. The wear plate of claim 9, wherein the lower side wall is thicker than the upper side wall.

13. The wear plate of claim 9, wherein said side walls of the wear plate vary in thickness throughout their length to dispose the slideway at an angle greater than that of the longitudinal axis of the bracket pocket.

14. A brake beam wear plate comprising:

an elongated U-shaped body of polymer material having spaced apart upper and lower side walls and an interconnecting wall, said side walls having inner and outer faces such that when the wear plate is mounted in a brake beam guide bracket the outer faces will extend substantially parallel to each other, said inner faces of the side walls defining a slideway for the ends of a brake beam and having means for providing a sloppy fit for the brake beam while causing the brake beam to move along a path when the brake system is actuated to provide a substantially ideal engagement of the brake shoes with the wheels of a car so that substantially uniform wear of the shoes will be achieved, and said means for providing a sloppy fit also inclining the slideway upwardly from the longitudinal axis of the outer surface of the wear plate.

15. The wear plate of claim 14, wherein the side walls of the wear plate vary in thickness throughout their length while maintaining a parallel relationship to each other.

16. A brake beam wear plate comprising:

an elongated U-shaped body of polymer material having spaced apart upper and lower side walls and an interconnecting wall, said side walls having inner and outer faces such that when the wear plate is mounted in a brake beam guide bracket the outer faces will extend substantially parallel to each other, said inner faces of the side walls defining a slideway for the ends of a brake beam and having means for providing a sloppy fit for the brake beam while causing the brake beam to move along a path when the brake system is actuated to provide a substantially ideal engagement of the brake shoes with the wheels of a car so that substantially uniform wear of the shoes will be achieved, and said means including ramp means along the slideway inclining upwardly from the longitudinal axis of the outer faces of the wear plate.

* * * * *

UNITED STATES PATENT AND TRADEMARK OFFICE

CERTIFICATE OF CORRECTION

PATENT NO. : 5,682,964

DATED : November 4, 1997

INVENTOR(S) : Richard F. Murphy

It is certified that error appears in the above-identified patent and that said Letters Patent is hereby corrected as shown below:

Col. 6, line 50, after "wall" insert a comma (,);
line 52, change the second occurrence of "and" to --an--;
Col. 8, line 40, change "surface" to --faces--.

Signed and Sealed this

Seventeenth Day of February, 1998

*Attest:*

*Attesting Officer*

BRUCE LEHMAN

*Commissioner of Patents and Trademarks*